US005079044A

United States Patent [19]

Schumacher et al.

[11] Patent Number: 5,079,044

[45] Date of Patent: Jan. 7, 1992

[54] OFFSET COATING APPARATUS WITH EXTERNAL COOLING

[75] Inventors: Thomas H. Schumacher, Downers Grove; Thaddeus M. Przybylowski, Jr., Worth, both of Ill.

[73] Assignee: WPC Machinery Corporation, Downers Grove, Ill.

[21] Appl. No.: 486,331

[22] Filed: Feb. 28, 1990

[51] Int. Cl.[5] ..... B05C 1/08; B05D 1/28

[52] U.S. Cl. ..... 427/428; 118/69; 118/262; 118/602

[58] Field of Search ..... 118/69, 212, 262, 602; 427/428

[56] References Cited

U.S. PATENT DOCUMENTS

| | | | |
|---|---|---|---|
| 863,429 | 8/1907 | Norris | 118/261 |
| 2,368,500 | 1/1945 | Taylor et al. | 101/350 |
| 2,986,088 | 5/1961 | Chase et al. | 101/350 |
| 2,992,456 | 7/1961 | Pearson et al. | 118/262 |
| 3,252,576 | 5/1966 | Miller | 210/137 |
| 4,138,965 | 2/1979 | Riese et al. | 118/262 |
| 4,497,250 | 2/1985 | Dressler | 101/350 |

FOREIGN PATENT DOCUMENTS

| | | | |
|---|---|---|---|
| 2068268 | 8/1981 | United Kingdom | 118/262 |

*Primary Examiner*—Michael Wityshyn

*Attorney, Agent, or Firm*—Welsh & Katz, Ltd.

[57] ABSTRACT

Coating apparatus and method of operation where the rotatable transfer cylinder and the rotatable metering roller of the coating device do not have internal cooling, but the heated coating liquid which is discharged from the nip between these rollers is itself cooled before being recirculated to a liquid holding pan beneath the transfer cylinder. A liquid catch tray is positioned below the metering roller for receiving coating liquid dripping from the metering roller, the catch tray having a downward incline toward the liquid holding pan, and the catch tray being spaced vertically and laterally away from the nip between the transfer cylinder and the metering roller to thereby provide an open space between the holding pan and the catch tray. A reservoir is positioned below the open space and below the nip for receiving coating liquid from the catch tray and the nip, and for receiving coating liquid overflowing from the holding pan.

25 Claims, 1 Drawing Sheet

OFFSET COATING APPARATUS WITH EXTERNAL COOLING

BACKGROUND OF THE INVENTION

The present invention relates to a coating device. In particular, the present invention relates to a coating device of the type which is useful as an accessory to a web printing press, and an improved method for operating such a coating device.

It is known to those skilled in the art that coating devices generally contain a horizontal coating or transfer cylinder which picks up a coating liquid from a liquid-containing pan, which is positioned under the transfer cylinder so that only a lower portion of the rotating transfer cylinder is immersed in the coating liquid. As the transfer cylinder rotates, the outer cylindrical surface thereof picks up the coating liquid. Although this liquid coating on the roller surface is generally very thin, it typically is not sufficiently thin to provide a properly functional coating thickness. If the coating liquid is a glue, for example, the thickness should range from about 3 mils to about 5 mils. If the coating thickness of glue is too thin, the necessary adhesion may not result; if gloss is being applied, it may not be sufficiently shiny; and if a scratch-off substance, one may be able to see through it and be able to read the covered indicia. Similarly, if a coating of micro-encapsulated fragrance is too thin, the bubbles may break and the fragrance prematurely released. On the other hand, if it is too thick, glue, for example, may "glob-up" and dry too slowly or unevenly, or it may totally fail to dry.

Thus, it is conventional to apply an excess of coating liquid to the transfer cylinder which is then removed from the outer cylindrical surface thereof by a doctoring or metering device. In general, one preferred metering device is a horizontal metering roller which coacts with the transfer cylinder to provide an open nip between the rotating surfaces of the two rollers. The gap between the two rollers is sized so that the nip will reduce the thickness of the coating liquid on the transfer cylinder to a desired final thickness.

When the transfer cylinder and the metering roller are rotated in a concurrent direction at the metering nip, the procedure is referred to as an extrusion metering process. The extrusion metering process pinches the liquid upon the outer cylindrical surface of the transfer cylinder at the pinch point between the transfer cylinder and the metering roller to thereby extrude the excess of coating liquid away from the nip between the two rollers, and to thereby drop this excess liquid back into the liquid holding pan in which the bottom portion of the rotating transfer cylinder is immersed in the coating liquid. This activity of pinching the coating liquid in the nip between the two rollers exerts work on the coating liquid, thereby heating the excess coating liquid which falls from the nip back into the pan. In general, the returned excess coating liquid has an increased temperature of from about 2° F. to about 10° F.

If the rotating transfer cylinder and metering roller are rotated in a counter direction at the nip, the procedure is referred to as a shearing type of metering process. The shearing process also performs work upon the coating liquid which is on the outer surface of the transfer cylinder. However, this work does not heat the excess coating liquid, which drops from the nip back into the coating liquid pan, to as great a degree as is found when the metering of the excess liquid is undertaken by the extrusion process.

It is undesirable for hot coating liquid to fall back into the pan of coating liquid which is beneath the nip point between the two rollers, since this falling liquid eventually heats the coating liquid within the pan to an excessive temperature in terms of reliable operation.

Accordingly, it is typical to pass a coolant, such as cooling water, through both the transfer cylinder and the metering roller of the coating device. Such cooling systems eliminate the problem of the hot, excess coating liquid heating the liquid contents within the pan to an undesirable level. However, these systems introduce other disadvantages to the liquid coating apparatus.

In particular, cooling the rollers adds capital expense to the coater. Moreover, cooled rollers add maintenance expense since it is necessary to maintain proper seals around the rotating portions of the cooling system which may be located at the axes of the cooled coacting rollers, and various other seals which may be found inside of the rotating rollers. Moreover, it is well known that more effective heat transfer is achieved from the hollow interior of the roller to the surface where the cooling is to be accomplished, if the thickness of the roller is smaller. However, thin hollow rollers may have insufficient rigidity to avoid deflection, particularly when the axial length of the rollers is a substantial dimension, and rollers which exhibit deflecting outer surfaces are often unable to lay down a precise film thickness for quality coating results.

With this then being the state of the art, it is an object of the present invention to provide an improved coating apparatus which requires reduced capital expenditure for the fabrication of the transfer cylinder and the metering roller.

It is another object of the present invention to provide an improved coating apparatus having reduced maintenance requirements for the coacting transfer and metering rollers.

It is a further object of the present invention to provide rigid non-deflecting transfer and metering rollers which lay down a precise film thickness for quality coating results.

These and other objects of the present invention, as well as the advantages thereof, will become apparent from the following detailed description when read in conjunction with the illustrated drawing, in which FIG. 1 is a simplified schematic representation showing various embodiments of the improved coating apparatus of the present invention.

SUMMARY OF THE INVENTION

In general, the objects of the present invention are achieved by eliminating the hollow, internally cooled, rotating cylinders of the transfer cylinder and the metering roller of the prior art coating devices. In the present invention, such rollers are solid, non-cooled cylinders so that they have substantial rigidity and are non-deflecting. Accordingly, the transfer cylinder and the metering cylinder of the present invention are able to lay down a precise film thickness upon an impression roller or printing roller in order to achieve high quality coating results.

More particularly, where the prior art coating devices utilize cooling of the cylinders in order to maintain a proper temperature level for the coating liquid, by the practice of the present invention the proper temperature level for the coating liquid within the coating liquid holding pan is achieved by passing the heated coating liquid from the nip between the transfer cylinder and the metering roller to a drain system which is offset from the position of the liquid holding pan, so that the hot liquid is independently cooled before being circulated back to the coating liquid holding pan.

Thus, whereas the prior art coating devices cool the transfer and metering rollers, the apparatus of the present invention cools the heated excess coating liquid which is discharged from the metering nip.

Accordingly, in its apparatus aspects the present invention comprehends a coating apparatus which includes a rotatable transfer cylinder having an outer cylindrical surface for receiving a coating liquid thereon. The coating apparatus additionally includes a rotatable metering roller having an outer cylindrical surface parallel to the transfer cylinder and spaced therefrom to provide a close dimensioned open nip therebetween for metering a thickness of coating liquid on the transfer cylinder when the rollers are rotated. The coating apparatus further includes a rotatable impression roller having an outer cylindrical surface parallel to the transfer cylinder and spaced therefrom to provide a nip therebetween for transferring metered coating liquid from the transfer cylinder to the impression roller when the rollers are rotated. A liquid holding pan is located below the transfer cylinder for containing a coating liquid, the holding pan containing a lower portion of the rotatable transfer cylinder as it is rotated, and the pan being spaced vertically and laterally away from the nip between the transfer cylinder and the metering roller. A liquid catch tray is positioned below the metering roller for receiving liquid dripping therefrom, the catch tray having a downward incline toward the holding pan, and the tray being spaced vertically and laterally away from the nip between the transfer cylinder and the metering roller to thereby provide an open space between the holding pan and the tray. Finally, a drain throat is positioned below the open space and below the nip between the transfer cylinder and the metering roller, for receiving coating liquid from the catch tray and the nip, and for receiving coating liquid over-flowing from the holding tray.

In its apparatus aspects the present invention further comprehends the foregoing apparatus as defined in the preceding paragraph, wherein a first liquid conduit means is provided for withdrawing coating liquid from the drain throat, and a heat exchanger is provided for receiving the coating liquid from the first liquid conduit means and for cooling the received coating liquid. In addition, a second liquid conduit means is provided for passing cooled coating liquid from the heat exchanger to the liquid holding pan.

A clearer understanding of the present invention may now be obtained from the disclosure which follows.

DESCRIPTION OF THE DRAWING FIGURE

FIG. 1 is a simplified schematic representation of the coating apparatus of the present invention, shown as a schematic sectional view.

DESCRIPTION OF THE PREFERRED EMBODIMENTS

Figure 1:
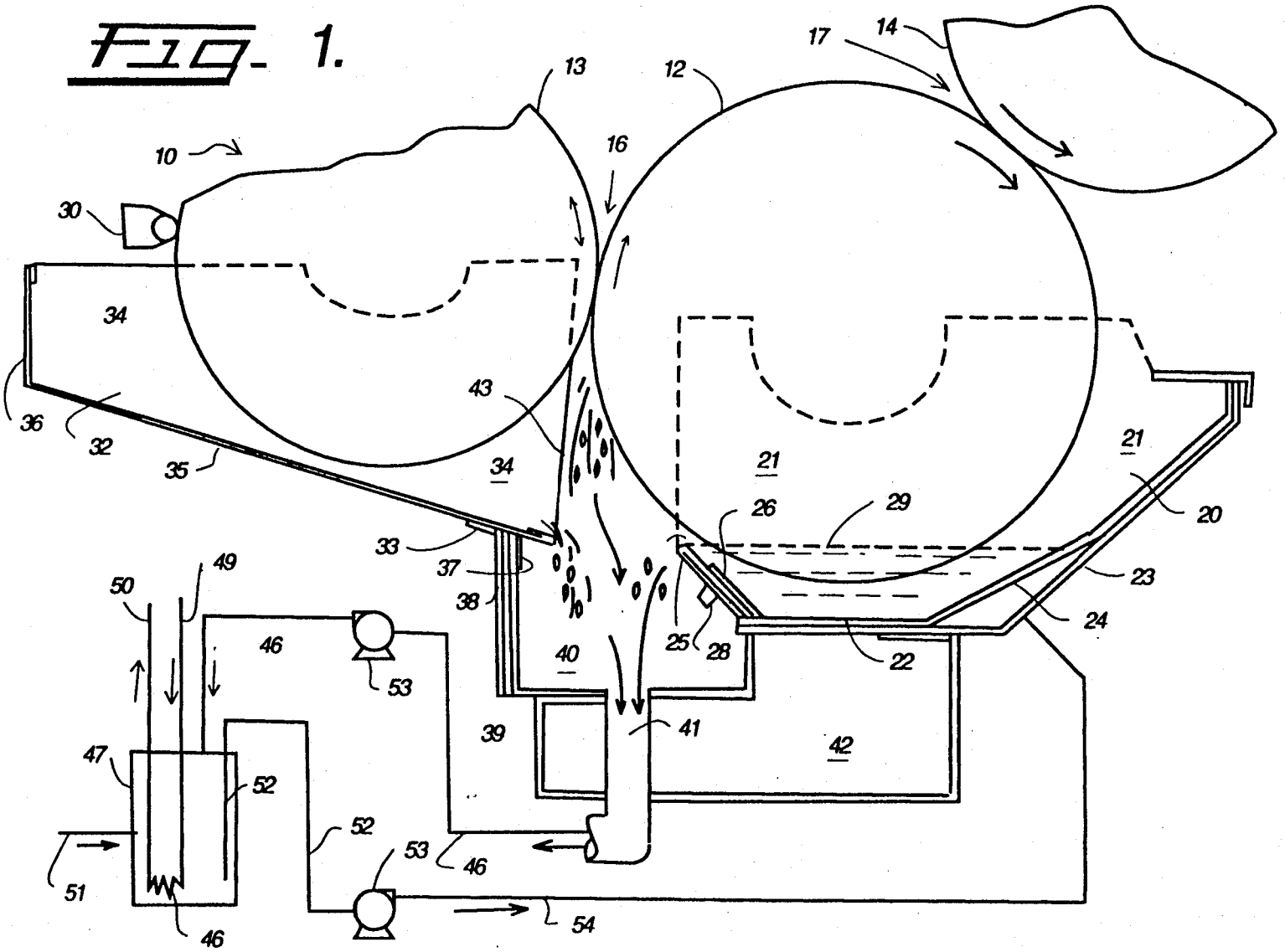

Referring now to FIG. 1, there is shown the improved coating apparatus 10 of the present invention. The coating apparatus includes a transfer cylinder or roller 12, a metering roller 13 (often referred to as a doctor roller), and an impression roller or printing cylinder 14, only a portion of which is shown. On the left hand side of the transfer cylinder is an open nip 16 which is found between the transfer cylinder 12 and the metering roller 13. Nip 16 has a close dimensioned gap between the two rotating rollers 12 and 13 for metering the thickness of coating liquid retained on the transfer cylinder. In addition, on the right hand side of the transfer cylinder 12 there is found a nip 17 between the transfer cylinder and the printing roller 14.

A liquid holding pan 20 is positioned beneath the transfer cylinder 12. The pan 20 has a back wall 21, a front wall (not shown, but substantially similar to the back wall), a bottom 22, and an end wall 23. The pan also includes a manifold or baffle 24 which is preferably positioned generally midway between the front and back walls and terminates several inches short of the walls to permit the liquid to flow around the ends of the baffle into the main portion of the pan 20. It is also preferred that the baffle have a number of small apertures in it to permit some flow through the baffle. As will be discussed more fully hereafter, the liquid is pumped into the pan through a conduit which terminates into the pan 20 immediately behind the baffle 24. Because of the strong flow of liquid, were the baffle not present, many types of liquid may splatter out of the pan 20. The pan has an adjustable weir or dam 25, shown as a slidable plate held between an upper plate 26 and a lower plate 27. One or more thumb screws 28 may be found in the lower plate 27. Thumb screws 28 are provided in order to lock the dam 25 in a desired position in order to maintain a desired liquid level 29 (shown as a phantom line) in the pan 20 as fresh make-up liquid coating is passed into the pan 20 by means of line 54 in a manner which shall be set forth hereinafter.

A liquid catch tray 32 is found beneath the metering roller 13. The catch tray has a back wall 34, a front wall (not shown), a tray bottom 35 and an end wall 36. It can be seen that the liquid catch tray 32 is slightly inclined downwardly toward the liquid holding pan 20 and spaced therefrom. At the lower end of the inclined liquid catch tray and on the underside of the bottom 35, a channel member 37 is attached. The channel member 37 provides a means by which the liquid catch tray is removably supported in the liquid coating apparatus 10 in order to afford access for cleaning the metering roller and the transfer cylinder, as well as a reservoir 40, as may be required. A support plate 38 also supports a portion of the inclined lower end of the liquid catch tray 32 upon an inclined lip 33.

The channel member 37 is seated upon a sidewall 39 of the reservoir 40 as shown. The reservoir 40 collects coating liquid overflowing from the adjustable weir 25 of the pan 20. In addition, the reservoir 40 receives heated coating liquid which is being pressed out (metered or doctored) from the nip 16 as the transfer cylinder 12 and the metering roller 13 meet at the close dimensioned open metering nip 16 for adjustment of the thickness of the coating liquid on the transfer cylinder 12. Finally, heated coating liquid which drips off of the metering roller 13 onto the catch tray 32, also flows from the inclined end of the catch tray bottom 35 and into the reservoir 40. In this regard, if the metering roller 13 rotates in the counterclockwise direction as shown in FIG. 1, very little liquid should drip into the catch tray 32. However, if it is rotated in the clockwise direction, a preferably felt surfaced wiper bar 30 is provided to wipe the liquid, and in this rotational direction, a significant amount of liquid will drip from the metering roller. The accumulated liquids collected in the reservoir 40 are then passed through the drain opening 41. Sheet metal walls, such as back wall 21 (and the equivalent front wall which is not shown in FIG. 1), are preferably provided on opposite ends of the pan 20 to catch occasional drips that may occur at the ends of the transfer cylinder 12.

A sealed joint 43 is formed in an abutment of the back wall 34 of the liquid catch tray 32 and the back wall 21 of the liquid holding pan 20. This sealed joint 43 is inclined toward the transfer cylinder 12. An equivalent inclined sealed joint is formed by an abutment of the front wall of the catch tray 32 and the front wall of the liquid holding pan 20, but these elements do not appear in FIG. 1. These inclined abutment joints afford ease of removal of the liquid catch tray 32 from on top of the reservoir side wall 39 and the support plate lip 33. Cleaning of the transfer cylinder 12, the metering roller 13, and the reservoir 40, as may be required, is made easier by making the liquid catch tray 32 thus removable.

As previously noted hereinabove, the present invention differs from the prior art liquid coating devices in that the prior art devices provide cooling of the coating liquid by circulating a coolant through the transfer cylinder 12 and the metering roller 13, whereas the inventive apparatus does not cool the rollers, but cools the coating liquid. The coating liquid which is heated as it is discharged from the nip 16 is cooled in order to provide a stable temperature for the coating liquid which is contained within the liquid holding pan 20. In the present invention, the heated coating liquid does not pass back into pan 20, but passes through the reservoir 40 and the drain opening 41 into the conduit that extends back to the supply of liquid. The drain reservoir or sump 40 does not hold a high level of coating liquid, but normally is merely a temporary holding sump. In general, the coating liquid which accumulates in the sump 40 is withdrawn therefrom via a conduit 46 which has suction applied to it to pull the liquid back into the supply.

In accordance with an aspect of the present invention which is schematically represented by the system located at the lower right of the liquid coating apparatus 10, the heated coating liquid is removed from the sump 40 via the liquid conduit 46 which passes the heated coating liquid into a liquid receiver vessel 47.

In accordance with an important aspect of the present invention, it is important that with many of the liquids that are pumped into the pan be removed from the sump by suction because of the extremely high viscosity of them. In this regard, a pump 53 is located in a conduit 46 for returning the liquid into a receiver 47. It is preferred that the conduit have a diameter of approximately 2 inches to accommodate the necessary flow. Because the liquid may be so viscous that it will not flow without the suction being applied, a gravity flow system will not be effective for many of the liquids that are contemplated being used. Also because the liquid itself provides the cooling of the transfer cylinder 12 that is accomplished, it is necessary to provide rapid recirculation of the liquid through the pan 20. The flow is preferably such that if the liquid is not replenished in the pan 20, it will be substantially emptied in approximately less than one minute. It should also be understood that the rotation of the transfer cylinder 12 acts as a pump for moving the liquid from the right side of the pan to the left as shown in the drawing. Without such rotation, many of the high viscosity liquids would simply build up on the right side of the pan. Also, for the reason that the viscosity of many liquids is so high, the bottom of the reservoir 40 is lowered relative to the bottom of the pan 20, so that it will hold more liquid than it would if it were at the same elevation. The liquid receiver vessel 47 may be a tank or other receiving device, or where only a small amount of heated coating liquid is being circulated, the liquid receiver 47 may be a single shipping drum of the coating liquid, as purchased from the supplier. In any event, the receiving vessel 47 contains a cooling coil 48 which has a cooling liquid inlet line 49 for cold water or a refrigerant, such as Freon, and a cooling liquid outlet line 50 for the discharge of the warmed cooling water or refrigerant from the cooling coil 48. The receiver vessel 47 also includes an inlet line 51 for adding make-up coating liquid to the receiver vessel 47, as required. In those embodiments where the receiver vessel 47 is a shipping drum containing fresh coating liquid, no make-up line 51 is required. When the heated coating liquid has been cooled to the proper temperature in the receiving vessel 47, coating liquid is withdrawn from the vessel via a withdrawal or suction line 52 and passed to the pump 53. While it is preferred that a single pump 53 having a double head be provided, so that the suction can be applied to the conduit 46 and positive pressure to conduit 54, it should be appreciated that two pumps could be provided, i.e., one pump for each of the conduits 46 and 54. The pump passes the cooled coating liquid, which is now typically at a temperature of from about 50° F. to about 70° F., via a line 54 back to the liquid holding pan 20.

From the foregoing description, those skilled in the art will realize that the apparatus of the present invention is not merely limited to liquid coating devices, but that is also applicable for use in specialty printing devices such as gluers and/or coaters that may be used in an off-set printing press line. Coating liquids which are usable in the apparatus of the present invention include water-base, solvent-base, or U.V. coatings. Typical coatings are inks, scratch-off coatings, microencapsulated fragrances, cosmetic slurries, gloss coatings and glue coatings. Thus, as used herein, the terms "coating apparatus", "coating device", and the like are intended to apply to devices of the present invention regardless of the field of use or the type of coating liquid utilized.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A coating apparatus adapted for use with a supply of coating liquid having a desired temperature, said apparatus comprising:

a) a rotatable transfer roller having an outer cylindrical surface for receiving a coating liquid thereon;

b) a rotatable metering roller having an outer cylindrical surface parallel to said transfer roller and spaced therefrom to provide a closely dimensioned open nip therebetween for metering a thickness of coating liquid on the transfer roller when said rollers are rotated;

c) a liquid holding pan below said transfer roller for containing a coating liquid, said holding pan containing a lower portion of said rotatable transfer roller as it is rotated, and said pan being spaced vertically and laterally away from the nip between the transfer roller and the metering roller to provide an open space below said nip; and, d) drain means positioned below said open space and below the nip between said transfer roller and said metering roller, for receiving coating liquid from said nip, and for receiving coating liquid overflowing from said holding pan.

2. A coating apparatus according to claim 1 wherein said liquid holding pan contains an overflow dam for allowing a portion of liquid to overflow from said pan into said drain means.

3. A coating apparatus according to claim 2 wherein said overflow dam is adjustable to maintain a desired liquid depth with said pan.

4. A coating apparatus according to claim 1 wherein a liquid catch tray is positioned below said metering roller and removably mounted thereunder to provide access to said drain means, said transfer roller, and said metering roller.

5. A coating apparatus according to claim 1 further including first liquid conduit means for withdrawing coating liquid from said drain means, heat exchanger means for receiving said coating liquid from said first liquid conduit means and for cooling said received coating liquid, and second liquid conduit means for passing cooled coating liquid from said heat exchanger means to said liquid holding pan.

6. A coating apparatus according to claim 5 wherein said first liquid conduit means includes a pump.

7. A coating apparatus according to claim 5 wherein said second liquid conduit means includes a pump.

8. A coating apparatus according to claim 1 further including a liquid catch tray below said metering roller for receiving liquid dripping therefrom, said catch tray having a downward incline toward said liquid holding pan, and said catch tray being spaced vertically and laterally away from the nip between the transfer roller and the metering roller to thereby provide an open space between the holding pan and the catch tray.

9. A coating apparatus which comprises:

a) a rotatable transfer roller having an outer cylindrical surface for receiving a coating liquid thereon;

b) a rotatable metering roller having an outer cylindrical surface parallel to said transfer roller and spaced therefrom to provide a closely dimensioned open nip therebetween for metering a thickness of coating liquid on the transfer roller when said rollers are rotated;

c) a liquid holding pan below said transfer roller for containing a coating liquid, said holding pan containing a lower portion of said rotatable transfer roller as it is rotated, and said pan being spaced vertically and laterally away from the nip between the transfer roller and the metering roller;

d) a liquid catch tray below said metering roller for receiving liquid dripping therefrom, said catch tray having a downward incline toward said holding pan, and said catch tray being spaced vertically and laterally away from the nip between the transfer roller and the metering roller to thereby provide an open space between the holding pan and the tray;

e) drain means positioned below said open space and below the nip between said transfer roller and said metering roller, for receiving coating liquid from said catch tray and said nip, and for receiving coating liquid overflowing from said holding pan;

f) first liquid conduit means for withdrawing coating liquid from said drain means;

g) a liquid receiver vessel for receiving coating liquid from said first liquid conduit means;

h) a heat exchanger within said liquid receiver vessel for cooling coating liquid received from said first liquid conduit means; and, i) second liquid conduit means for passing cooled coating liquid from said liquid receiver vessel to said liquid holding pan.

10. A coating apparatus according to claim 9 wherein said second liquid conduit means includes a pump.

11. A coating apparatus according to claim 9 wherein said liquid holding pan contains an overflow dam for allowing a portion of liquid to overflow from said pan into said drain means.

12. A coating apparatus according to claim 11 wherein said overflow dam is adjustable to maintain a desired liquid depth within said pan.

13. A coating apparatus according to claim 9 wherein said liquid catch tray is removable to provide access to said drain means.

14. A coating apparatus according to claim 9 wherein said drain means includes a coating liquid reservoir between and below said pan and said tray, and means positioned adjacent opposite ends of said transfer roller for directing occasional drips of coating liquid from said opposite ends into said reservoir.

15. A coating apparatus according to claim 9 further including a rotatable impression roller having an outer cylindrical surface parallel to said transfer roller and positioned adjacent thereto to provide a nip therebetween for transferring metered coating liquid from said transfer roller to said impression roller when said rollers are rotated.

16. A coating apparatus which comprises:

a) a rotatable transfer roller having an outer cylindrical surface for receiving a coating liquid thereon;

b) a rotatable metering roller having an outer cylindrical surface parallel to said transfer roller and spaced therefrom to provide a closely dimensioned open nip therebetween for metering a thickness of coating liquid on the transfer roller when said rollers are rotated;

c) a liquid holding pan below said transfer roller for containing a coating liquid, said holding pan containing a lower portion of said rotatable transfer roller as it is rotated, and said pan being spaced vertically and laterally away from the nip between the transfer roller and the metering roller;

d) a liquid catch tray below said metering roller for receiving liquid dripping therefrom, said catch tray having a downward incline toward said holding pan, and said tray being spaced vertically and laterally away from the nip between the transfer roller and the metering roller to thereby provide an open space between the holding pan and the tray;

e) drain means positioned below said open space and below the nip between said transfer roller and said metering roller, for receiving coating liquid from said catch tray and said nip, and for receiving coating liquid overflowing from said holding pan;

f) first liquid conduit means for withdrawing coating liquid from said drain means;

g) a first liquid pump means for passing withdrawn coating liquid from said first conduit means to a heat exchanger means;

h) a heat exchanger means for receiving withdrawn coating liquid from said first liquid pump means and for cooling said received coating liquid; and, i) second liquid conduit means for passing cooled coating liquid from said heat exchanger means to said liquid holding pan.

17. A coating apparatus according to claim 16 wherein said second liquid conduit means includes a second liquid pump means for receiving cooled coating liquid from said heat exchanger means, and a third liquid conduit means for passing cooled coating liquid from said second liquid pump means to said liquid holding pan.

18. A coating apparatus according to claim 16 wherein said drain means includes a coating liquid reservoir between and below said pan and said tray, and means positioned adjacent opposite ends of said transfer roller for directing occasional drips from said opposite ends into said reservoir.

19. A coating apparatus according to claim 16 wherein said liquid holding pan contains an overflow dam for allowing a portion of liquid to overflow from said pan into said drain means.

20. A coating apparatus according to claim 19 wherein said overflow dam is adjustable to maintain a desired liquid depth within said pan.

21. A coating apparatus according to claim 16 wherein said liquid catch tray is removable to provide access to said drain means.

22. A coating apparatus according to claim 16 further including a rotatable impression roller having an outer cylindrical surface parallel to said transfer roller and positioned adjacent thereto to provide a nip therebetween for transferring metered coating liquid from said transfer roller to said impression roller when said rollers are rotated.

23. A coating method which comprises the steps of:

a) passing a coating liquid into a liquid holding pan positioned below a rotating transfer roller having an outer cylindrical surface receiving coating liquid thereon;

b) maintaining the level of coating liquid within said holding pan with make-up coating liquid as said rotating transfer roller receives coating liquid on its outer cylindrical surface;

c) controlling the thickness of a layer of coating liquid on the outer surface of said transfer roller by passing the coating liquid received thereon through a closely dimensioned open metering nip between said rotating transfer roller and a rotating metering roller, said nip being laterally spaced from said holding pan;

d) receiving excess coating liquid falling from said metering nip and from said metering roller in a collecting means spaced from said holding pan;

e) passing said excess coating liquid from said collecting means to a heat exchanger means; and, f) passing cooled excess coating liquid from said heat exchanger means to said holding pan as a portion of said make-up coating liquid.

24. A coating method according to claim 23 wherein said excess coating liquid is passed from said collecting means to a liquid receiving vessel containing a heat exchanger means for cooling said excess coating liquid.

25. A coating method according to claim 23 wherein the level of coating liquid within said holding pan is maintained by passing an over-sufficiency of make-up coating liquid into said holding pan and allowing surplus coating liquid to overflow from said holding pan into said collecting means.

* * * * *